United States Patent [19]

Intengan

[11] 4,285,463

[45] Aug. 25, 1981

[54] DECANTING CENTRIFUGE

[75] Inventor: Franklin F. Intengan, Hialeah, Fla.

[73] Assignee: American Hospital Supply Corporation, Evanston, Ill.

[21] Appl. No.: 90,505

[22] Filed: Nov. 1, 1979

[51] Int. Cl.[3] ..... B04B 9/12

[52] U.S. Cl. ..... 233/26; 233/14 R

[58] Field of Search ..... 233/26, 27 R, 14 A, 233/14 R, 1 D, 12, 1 R; 210/323, 324, 360 R, 360 A

[56] References Cited

U.S. PATENT DOCUMENTS

| | | | |
|---|---|---|---|
| 3,401,876 | 9/1968 | Lucas | 233/26 |
| 3,420,437 | 1/1969 | Blum | 233/26 |
| 3,712,535 | 1/1973 | Genese | 233/26 |
| 3,722,789 | 3/1973 | Kennedy | 233/26 |
| 3,877,634 | 4/1975 | Rohde | 233/26 |
| 3,951,334 | 4/1976 | Fleming | 233/26 |

*Primary Examiner*—Robert W. Jenkins

*Attorney, Agent, or Firm*—Tilton, Fallon, Lungmus

[57] ABSTRACT

A decanting centrifuge particularly useful for clinical laboratory procedures requiring the washing and packing of red cells or other particles. An electromagnet having upper and lower planar pole faces rotates to drive a removable rotor head assembly and, during the decant cycle, holds a plurality of magnetically-attractable tube carriers in substantially vertical positions against its planar pole faces so that supernatant liquid is centrifugally discharged from the open upper ends of the tubes. Each tube carrier comprises a tube-holding member and a contact member, both of which have their upper end portions pivotally suspended from a support ring which is provided by the rotor assembly and which is coaxial with the rotatable magnet. The planar surfaces of the contact members engage the planar pole faces when the centrifuge is at rest and also when the electromagnet is energized and the rotor assembly is rotated to decant the liquid contents of the centrifuge tubes. Each tube-holding member has two outer side walls which meet along converging planes so that such walls will engage a centrifuge tube along a pair of spaced parallel lines during centrifuge operation, thereby permitting centrifuge tubes of different selected outside dimensions to be supported within the open-topped cavity of such tube-holding member.

23 Claims, 8 Drawing Figures

DECANTING CENTRIFUGE

BACKGROUND AND SUMMARY

U.S. Pat. No. 3,401,876 discloses an automated cell washing centrifuge which utilizes centrifugal force to decant supernatant solution as a final step in a cell washing sequence of steps. With the movable cover in its lowered position, the centrifuge tubes are held in inclined position so that during rotation of the rotor saline may be injected into each of the tubes to suspend and wash the cells and, as rotation continues, to pack the cells so that they form cell buttons in the tubes' lower ends FIGS. 10 and 11). Subsequent rotation with the cover in its raised position results in a decanting of the supernatant liquid from the tubes since, during such decanting step, the tubes are supported in substantially vertical positions (FIG. 14).

Later patents disclose modifications in structure and operation for controlling the angular disposition of the tubes during the wash and decant cycles. Thus, U.S. Pat. No. 3,722,789 discloses a centrifuge in which the weight distribution of the tube holder changes depending on whether rotor rotation is clockwise or counterclockwise; during clockwise rotation the centrifuge tube assumes its inclined position for washing and packing of the cells, whereas during counterclockwise rotation the tube assumes its generally vertical decant position. U.S. Pat. No. 3,951,334 similarly discloses a centrifuge in which the angular orientation of the centrifuge tubes is determined by the direction of rotor rotation, the pivotally-mounted tube holders being allowed to swing outwardly when the rotor (drive shaft) turns in a counterclockwise direction but being blocked by castellations against such outward swinging movement when the rotor moves in a clockwise direction.

In U.S. Pat. No. 3,420,437, a latching system in the form of a vertically movable restraining ring is used to secure the tubes in their generally vertical positions during the decant cycle. Although manual operation of the latching ring is shown, in a commercial version the ring is shifted between its latching and unlatching positions by a solenoid.

The centrifuge disclosed in U.S. Pat. No. 3,712,535 employs an electromagnetic holding device to retain the tubes upright during the decant cycle. The electromagnet is stationary and acts through an air gap to tilt the tube carriers from their normal rest positions into the positions they assume during decantation. Magnetic action is aided by a magnetic soft ring located intermediate between the stationary electromagnet and the tube carriers which is free to rotate with the tube carriers, thereby reducing the air gap.

The cell washing centrifuge of the present invention constitutes an improvement over prior constructions in which tubes are supported in generally vertical positions for decanting purposes and in downwardly and outwardly inclined positions for washing and packing of their cellular contents. An electromagnet rotates along with the tube carriers and is in direct surface engagement with the magnetically-attractable contact plates of those carriers when the carriers are in the vertical positions that they assume not only during a decant operation but also when the centrifuge is at rest. Because of such direct contact and the planar surface engagement between the carriers and the pole faces of the magnet, an electromagnet of relatively small dimensions and mass—factors of importance in view of the rotational mounting of the magnet—provides strong attractive forces for securely locking the carriers in their decant positions when the magnet is energized. The result is a highly efficient washing and decanting centrifuge of relatively simple, durable, and reliable construction.

Each of the tube carriers is composed of two main sections, a tube-holding section or member and a magnet-contacting section or member. The two members are suspended at their upper ends from a support ring which is a coaxial part of the rotor assembly. The respective members are independently suspended from the ring and are adjustably connected to each other at their lower ends for selective adjustment of the angle of the tube-holding member during decantation.

Each tube-holding member is typically formed of sheet metal and is folded to provide an open-topped cavity defined by generally planar upstanding side walls. Two of those side walls constitute outer walls which meet along a line lying in the vertical plane of swinging movement of the carrier and defining the outer limits of the cavity. The included angle at the junction of such planar outer walls falls within the general range of 70° to 170°. When the centrifuge is in operation, a centrifuge tube supported within the cavity engages the inside surfaces of the converging outer walls along two parallel lines of contact. Such spaced lines of contact not only distribute stresses on the fragile (glass) centrifuge tube but also adapt the carrier to receive and operate with centrifuge tubes of different outside diameters. The increased contact area also eliminates a tendency observed for light weight (plastic) centrifuge tubes to creep upwardly during decant.

Other features, advantages, and objects of the invention will become apparent from the specification and drawings.

DRAWINGS

DETAILED DESCRIPTION

Figure 1:
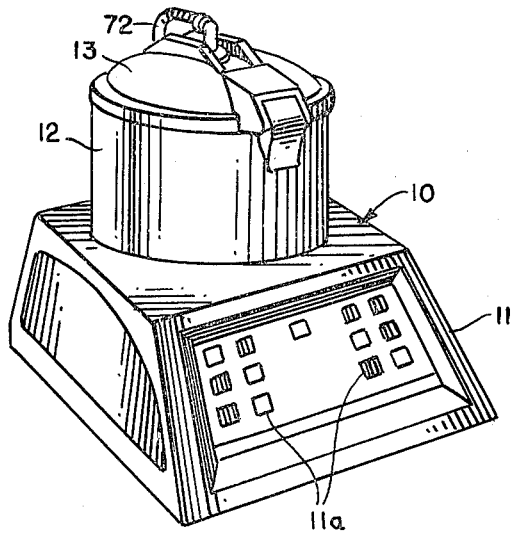
FIG. 1 is a perspective view of a washing and decanting centrifuge embodying this invention.

Referring to the drawings, the numeral 10 generally designates a centrifuge having a base 11 and a bowl 12 extending upwardly from the base and equipped at its upper end with a hinged cover 13. A direct current motor 14 (FIG. 8) is housed within the base and has a vertical upwardly extending drive shaft 15. Brushes 16 (only one of which is depicted in FIG. 8) contact the slip rings 17 which are carried by the motor shaft and which are part of an electromagnet 18 secured to the upper end of that shaft.

The electromagnet 18 includes a body or core 19 formed of magnetic stainless steel or any other suitable magnetic material, such body having an axial bore 20 which receives the upstanding end of the motor shaft 15 and which is secured thereto by screw 21 and drive pin 22. A magnetic winding 23 extends about the intermediate portion of the body and is in electrical circuit with brushes 16 which in turn are connected by leads 24 to a suitable source of current. Control means 25, diagrammatically illustrated in FIG. 8, directs electrical operation of the electromagnet and motor in the sequence selected by the user by push buttons 11*a* (FIG. 1). It will be understood by those skilled in the art that the electronics may be adapted to program operation of the centrifuge for whatever clinical laboratory operation it is desired that the centrifuge perform. For example, as described in the aforementioned patents, if such a centrifuge is adapted for use in performing the Coombs test, then the centrifuging operation will involve typically three successive washing and decanting cycles. Since the electronic timing and controlling components are conventional and form no part of the present invention, and since such components and their functions may be varied to suit the particular test or tests which the centrifuge is adapted to perform, a detailed description of such components is believed unnecessary herein.

Figure 3:
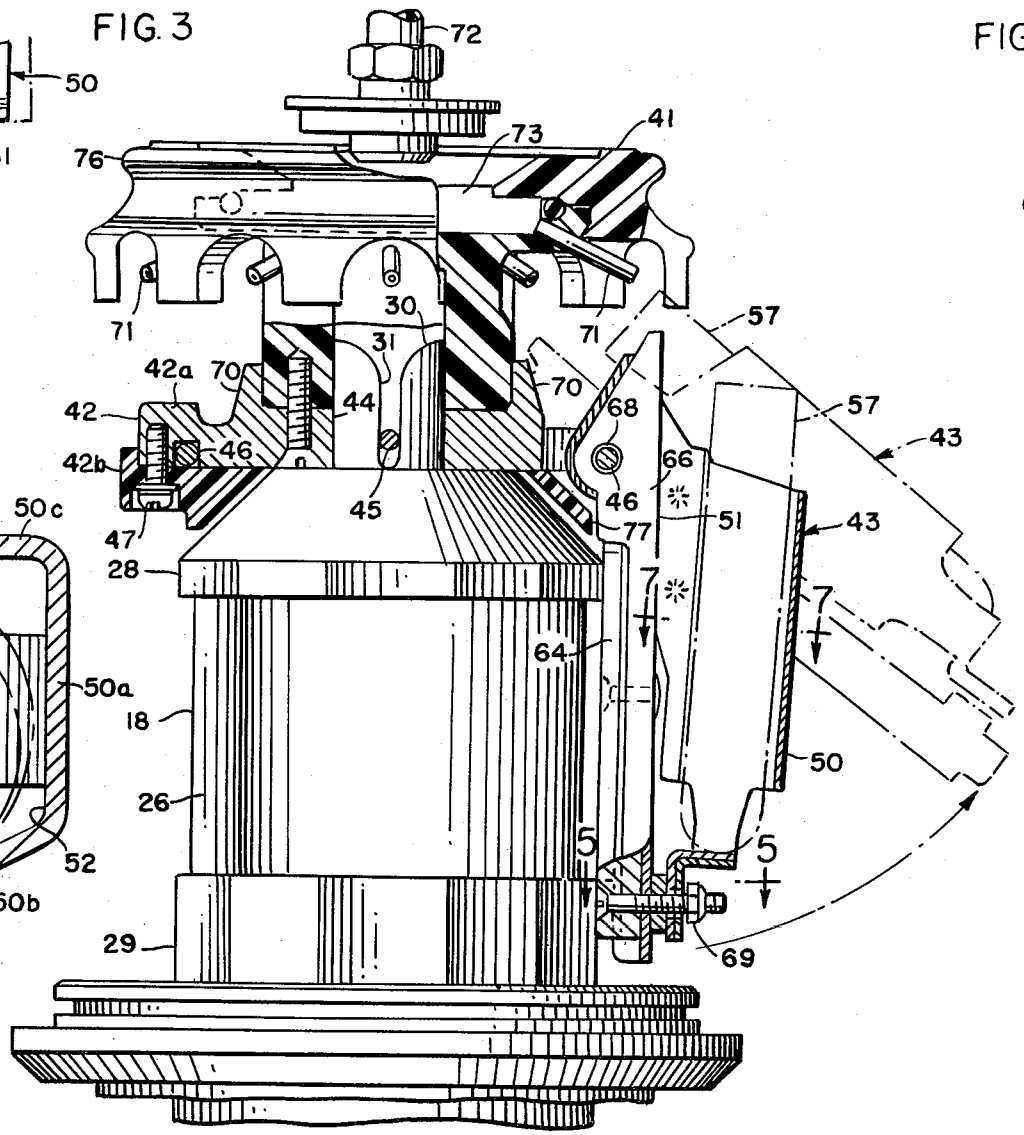
FIG. 3 is a side elevational view, shown partly in section, of the rotor head assembly in operative position with a tube carrier being shown in its resting or decanting position (in solid lines) and in its spinning or centrifuging position (phantom lines).
Figure 8:
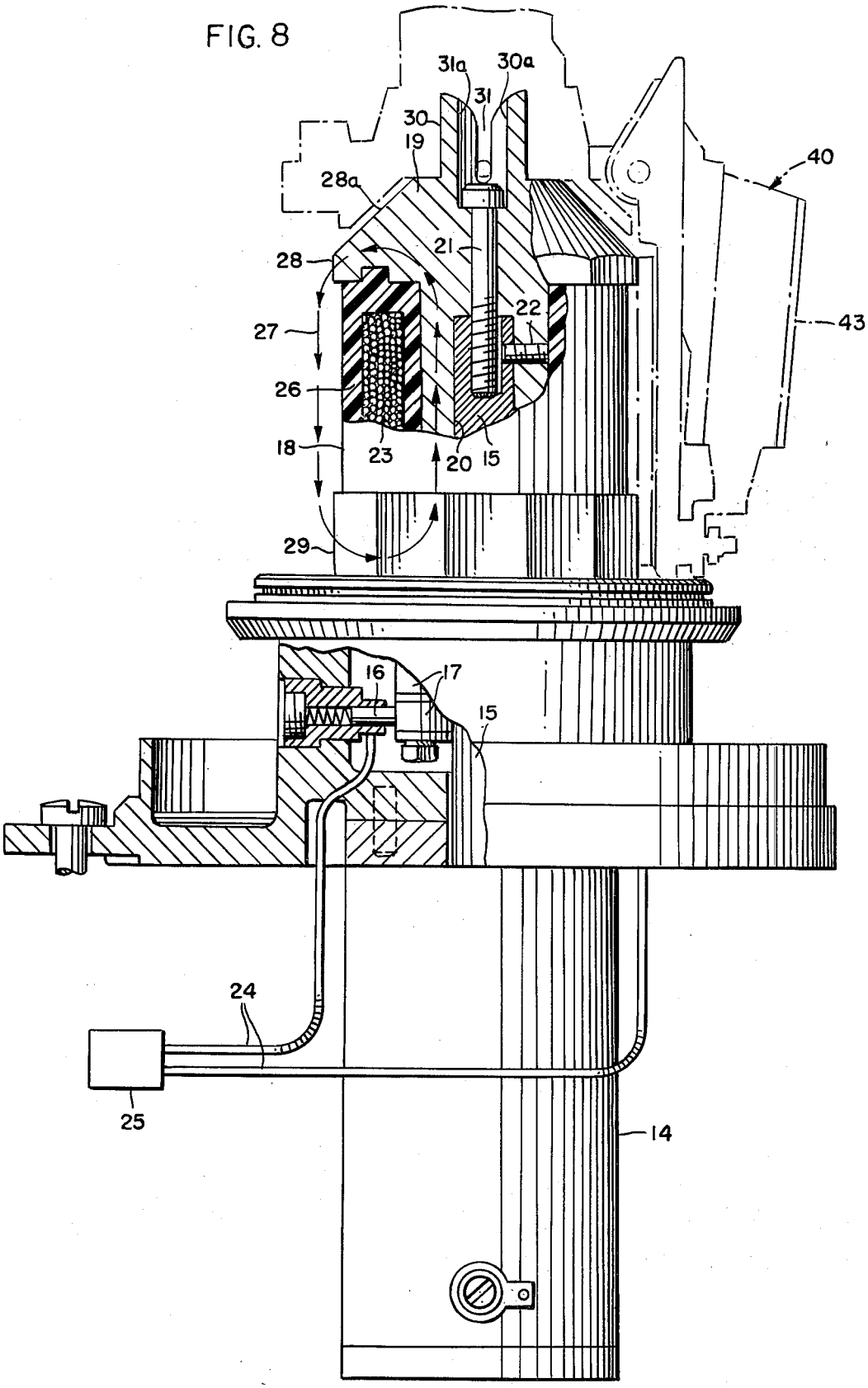
FIG. 8 is a vertical sectional view showing the relationship between the rotatable magnet and the drive assembly of the centrifuge.

Referring to FIGS. 3 and 8, the electromagnet 18 has its winding 23 embedded in an annulus 26 formed of epoxy resin or other suitable insulative encapsulating compound. Magnetic lines of force 27 travel through and about the core as generally indicated in FIG. 8 with the enlarged upper and lower ends 28 and 29 of the core functioning as the poles of the magnet.

It is to be noted that each of the poles has a plurality of planar lateral pole faces. When viewed in section, each pole has the outline of an equilateral equiangular polygon with each side of the polygon being coincident with one of the planar pole faces of the magnet. In the illustration given, each of the poles has 12 lateral faces; however, a greater or smaller number may be provided as desired.

Figure 2:
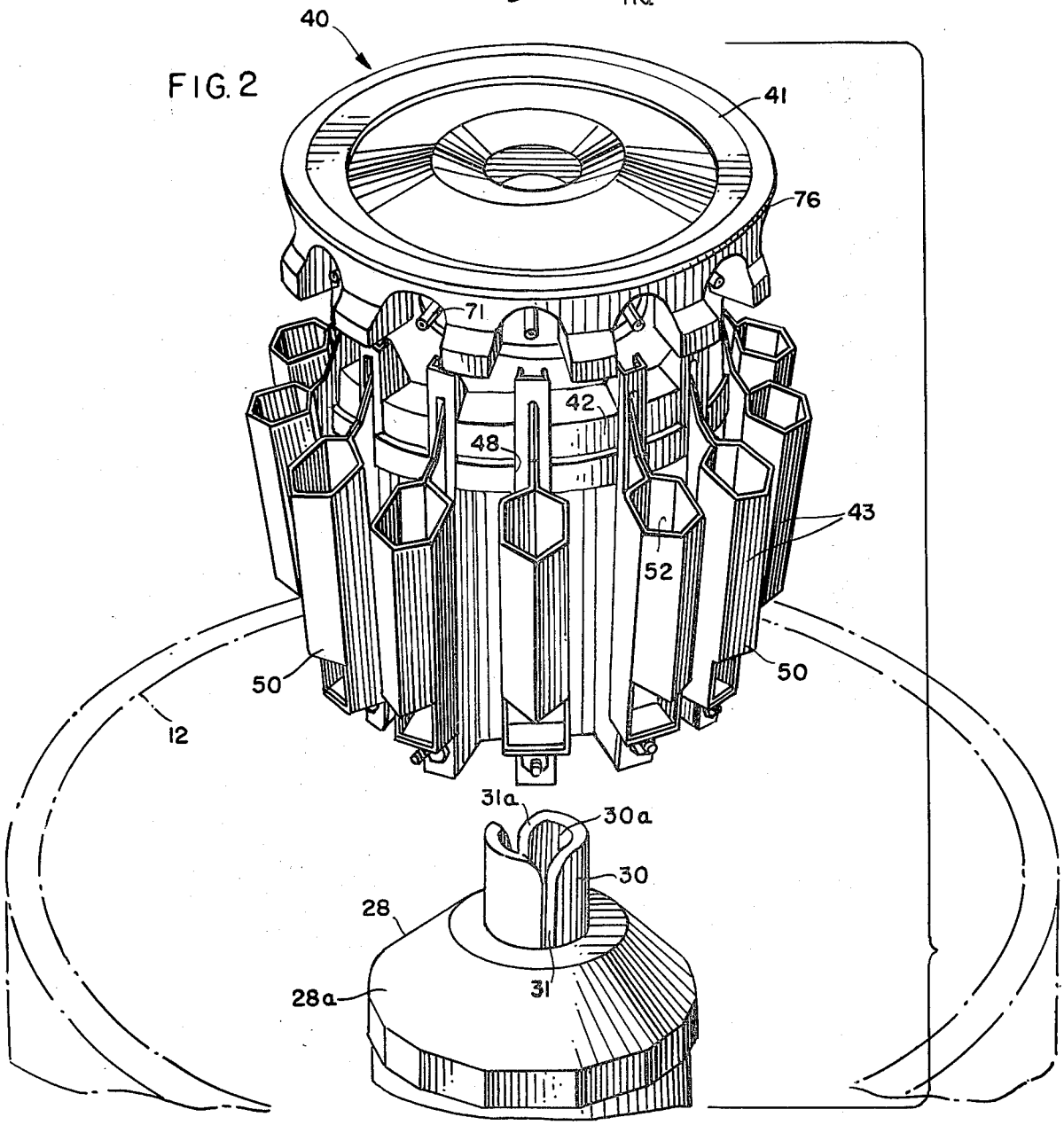
FIG. 2 is an exploded fragmentary perspective view emphasizing the rotor head assembly and illustrating the relationship between the head assembly and the rotatable electromagnet.

As illustrated most clearly in FIGS. 2 and 8, the upper pole 28 of the magnet core has an upwardly and inwardly sloping frusto-conical surface 28*a*. An integral sleeve 30 projects upwardly from the core and is counterbored at 30*a* to receive the head of screw 21 which secures the electromagnet to drive shaft 15. A pair of diametrically-disposed axially-extending slots 31 are formed in the sleeve, the surfaces defining such slots flaring outwardly at their upper ends 31*a* to facilitate attachment of a removable rotor head assembly in a manner hereinafter described.

The rotor head assembly 40 is illustrated in detached condition in FIG. 2 and comprises a distributor 41, an annular support member 42, and a plurality of tube carriers 43 suspended from the support member. As shown most clearly in FIG. 3, the annular support member 42 is coaxial with electromagnet 18 and drive shaft 15 and has a central opening 44 receiving the upstanding sleeve 30 of core 19. A transverse pin 45 extends diametrically across opening 44 and is received within the slots 31 of the sleeve to lock the parts against relative rotation without at the same time preventing intentional removal of the rotor head assembly.

The support member 42 is formed in two sections, an upper section 42*a* and a lower section 42*b*, with a support ring 46 clamped therebetween. In the illustration given, the lower section is formed of a rigid polymeric material such as polycarbonate. Similarly, the upper section 42*a* is preferably formed of a non-magnetic material; non-magnetic stainless steel is used in the embodiment shown but a rigid polymeric material similar to that of section 42*b* may also be used. The undersurface of the upper section is provided with an annular channel to receive ring 46 and the two sections are secured together by screws 47 or by any other suitable means.

A circumferential series of uniformly-spaced radially-extending slots 48 are formed about the periphery of member 42. Such slots receive the upper portions of the centrifuge tube carriers 43. Each tube carrier is suspended by ring 46 for pivotal movement between the generally vertical rest or decant position shown in solid lines in FIG. 3 and the outwardly and downwardly inclined spin position depicted by phantom lines in that same figure.

Figure 4:
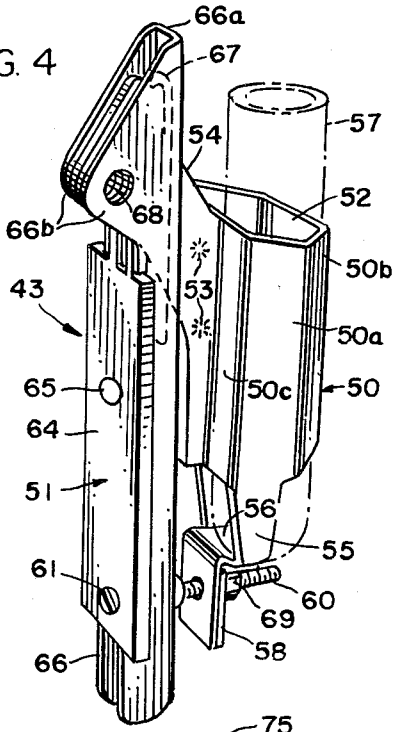
FIG. 4 is a perspective view of a tube carrier.
Figure 5:
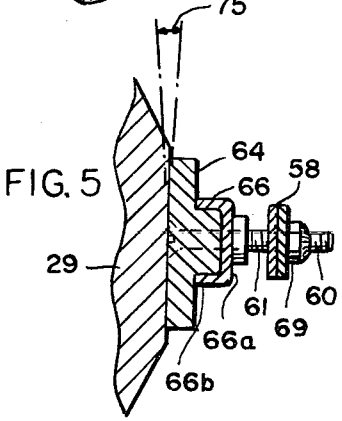
FIG. 5 is an enlarged sectional view taken along line 5—5 of FIG. 3.
Figure 6:
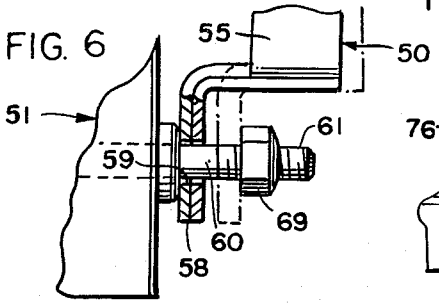
FIG. 6 is an enlarged fragmentary elevational view, shown partly in section, depicting the relationship between the lower ends of the pivotally-mounted members of a tube carrier.
Figure 7:
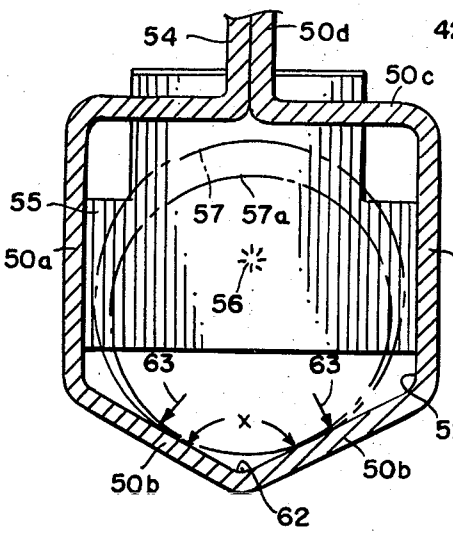
FIG. 7 is an enlarged sectional view taken along line 7—7 of FIG. 3.

Various features of the tube carriers 43 are illustrated most clearly in FIGS. 3–7. Each tube carrier is composed of two main components: a tube-holding member 50 and a contact member 51 (FIG. 4). The tube-holding member is folded from sheet metal to provide a cavity 52 defined by planar lateral side walls 50*a*, angular outer side walls 50*b*, the inner walls 50*c*. Referring particularly to FIGS. 4 and 7, it will be seen that the sheet material of the tube holder continues inwardly along the radial midplane of the holder to provide a pair of webs 50*d* which are welded together at points 53 to form a composite support arm 54 for the tube holder.

The tube-holding member 50 is open-topped and, in the embodiment illustrated, is also partially open at its bottom to facilitate draining and cleaning. Side walls 50*a* continue downwardly to provide a pair of spaced depending straps 55. The straps turn inwardly into overlapping relation and are preferably welded at 56 to form a rigid sling for supporting the lower end of a conventional glass centrifuge tube 57 received within cavity 52. The superimposed strap portions then proceed downwardly to form a double-walled depending flange 58 which extends in a generally vertical tangential plane (when the tube holder is at rest) with respect to the axis of centrifugation. The depending flange has a central aperture 59 through which the shank 60 of bolt 61 extends. As depicted in FIG. 6, the diameter of aperture 59 is substantially larger than that of shank 60.

The planar configuration of walls 50*a*–50*c*, *and particularly of converging outer walls 50b*, is significant. The inside surfaces of walls 50*b* extend along converging planes which meet along a line 62 which extends along the vertical plane of pivotal movement of the tube carrier. The included angle x formed by the planar inner surfaces of converging walls 50*b* should fall within the general range of 70° to 170°, the preferred range being approximately 90° to 150°. The angle x depicted in FIG. 7 is approximately 120°. By reason of the angular relationship between such planar inner surfaces of outer walls 50*b*, a centrifuge tube 57 supported within cavity 52 will contact such outer walls along two parallel lines of contact when the centrifuge is in operation and centrifugal force causes outward displacement of the centrifuge tube within the cavity. Such spaced parallel lines of contact are indicated by arrows 63 in FIG. 7.

Not only do the two lines of contact distribute stresses and reduce likelihood of tube breakage under the substantial forces generated during centrifuge operation (commonly about 1000 rcf), but they adapt the centrifuge for use with centrifuge tubes of different size. For example, centrifuge tube 57 may be a conventional 75 mm centrifuge tube having an outside diameter of approximately 12 mm; however, the tube carriers 43 will also accept standard centrifuge tubes 57*a* (FIG. 7) of the same length having an outside diameter of about 10 mm. Tubes of other size receivable in the cavities of the tube carriers may also be selected as long as the same size is used to fill all of the carriers for any given operating procedure.

Since the metal sheet from which the tube holding member is formed is folded inwardly and since side walls 50*a*–50*d* are uninterrupted, the resulting structure is quite strong and the danger that the forces generated over extended periods of use will cause distortions of the tube-holding member that might increase the size of the cavity is substantially reduced. Unlike some prior centrifuges where the walls of the tube holders take the form of tines or finger portions which curve about the centrifuge tube and terminate short of meeting each other along the outer side of the tube, there are no possibilities that side wall portions of tube holder 50 of this invention might separate in response to centrifugal forces even after extended service.

The contact member 51 is shown in FIGS. 3–5 as being formed of two connected parts. A magnetically-attractable contact plate 64 is secured to screw 61 and rivet 65 to the inside of a vertically-elongated beam 66 which, in the illustration given, is generally U-shaped in horizontal section. The planar inside surface of the contact plate 64 is positioned to make direct surface contact with the upper and lower pole faces of magnet 18 when the tube carrier is in its rest or decant position (FIG. 3). The outer wall 66*a* of the beam is slotted at 67 (FIG. 4) and the arm 54 of the tube-holding member 50 extends inwardly through the slot and into the space between the side walls 66*b* of the beam. Side walls 66*b* and arm 54 are provided with aligned openings 68 through which support ring 46 extends (FIG. 3).

The contact member 51 and tube-holding member 50 are therefore suspended at their upper ends from support ring 46 in a manner which permits limited independent pivotal movement of such members. The range of independent movement of the tube-holding member 50 with respect to the contact member 51 is small and is controlled by the position of the lock nut 69 on bolt 61. FIG. 6 depicts the position of the tube-holding member when the centrifuge is inoperative and the tube carrier is at rest (i.e., with contact plate 64 against the planar pole faces of the magnet, FIG. 3), whereas in broken lines in the same figure the tube-holding member 50 is shown in the position it would assume when the contact member 51 remains in contact with the magnet but the centrifuge is operated in its decant mode. Centrifugal force causes the lower end of the tube-holding member 50 to swing outwardly to the extent permitted by adjustment nut 69. Therefore, by turning the adjustment nut one way or the other, each tube carrier 43 may be finely tuned to discharge the desired amount of supernatant liquid from each centrifuge tube during the centrifuge's decant cycle.

During the spin cycle, when magnet 18 is deenergized, the tube carriers pivot outwardly until the upper ends of the tube-holding members, or the contact members, or both, engage annular shoulder 70 of support member 42 (FIG. 3). The shoulder therefore serves as a stop to limit the extent of outward swinging movement of the tube carriers under the influence of centrifugal force. It will be noted that when the carriers are disposed in their outwardly angled positions, the open tops of the centrifuge tubes are aligned and in close proximity with the discharge nozzles 71 of distributor 41. In the same manner generally disclosed in U.S. Pat. No. 3,401,876, saline may enter the distributor through line 72, flow into distribution chamber 73, and be discharged simultaneously into all of the centrifuge tubes through nozzles 71 while the centrifuge is in full operation. Such saline, impelled by centrifugal force, mixes with the cells in the centrifuge tubes 57. The flow of saline is then interrupted and as the rotor head continues to spin the washed cells migrate to the lower ends of the tubes to form tightly packed cell buttons. Since such operations are conventional and are disclosed in the aforementioned patents, further description of the fluid distributing operation, and the cell washing and packing operations, is believed unnecessary herein.

At the end of a spin cycle, as the rotor head decelerates and finally stops, the tube carriers 43 swing downwardly under the force of gravity into the rest positions depicted in FIG. 3. When each tube carrier is in its vertical rest position, its contact plate 64 is in direct surface engagement with the planar pole faces of the upper and lower poles 28 and 29 of the magnet. Self seating is promoted by forming the apertures 68 through the upper portions of the tube-holding member 50 and contact member 51 with diameters substantially larger than that of support ring 46 (FIG. 3). As a result, there is sufficient play or looseness in the pivotal mounting of each tube carrier 43 to insure direct surface contact between the pole faces and the inside surface of each contact member. The extent of such play is somewhat diagramatically indicated by arrow 75 in FIG. 5.

The decant cycle commences with the tube carriers in their normal rest positions but with magnet 18 energized to hold contact members 51 in surface engagement with the pole faces despite centrifugal force acting upon the tube carriers and the centrifuge tubes (and their contents) as the drive shaft, magnet, and rotor head assembly rotate. The tube-holding members 50 pivot outwardly slightly, to the limits permitted by adjustment nuts 69 (FIG. 6), so that the centrifuge tubes will automatically assume positions which will cause the desired amount of liquid to be decanted therefrom. Thereafter, motor operation is interrupted and, when the rotor head assembly has come to a full stop, magnet 18 is deenergized.

It has been found beneficial to apply a demagnetizing transient pulse of current to the winding following completion of the decant cycle. By momentarily reversing the direction of current flow, the poles of the magnet and the contact members are relieved of residual magnetism that might otherwise interfere with smooth operation at the commencement of a subsequent spin cycle. It is conceivable that other techniques might be utilized to avoid problems that might be caused by residual magnetism as, for example, by forming the contact plates 64 of soft iron rather than a material more likely to hold a residual magnetic charge. It is believed preferable, however, to form the contact member 51, and especially the contact plate thereof, of a more durable material such as magnetic stainless steel, and to then use a demagnetizing pulse to remove residual magnetism, not only because of greater durability and reliability but also because residual magnetism may under certain circumstances have beneficial effects. For example, should the power supply to the centrifuge be interrupted during the decant cycle, residual magnetism will have the effect of maintaining the tube carriers 43 in their decant positions as the rotor head assembly and electromagnet coast to a stop.

The distributor 41 is provided with a rim 76 which assists a user in gripping the rotor head assembly and lifting it, along with the centrifuge tubes which it supports, from electromagnet 18. When the assembly has been lifted free, tube carriers 43 swing inwardly slightly until contact members 51 engage edge 77 of the lower section **42*b* of support member 42 (FIG. 3). Edge 77 therefore serves as a stop to limit the extent of inward pivotal movement of the tube carriers and allows the rotor head assembly to assume a stable condition when placed on a suitable supporting surface. When the rotor head assembly is to be replaced, it is simply lowered over the magnet as indicated in FIG. 2, the frusto-conical surface 28*a* of the upper pole camming the lower ends of the tube carriers 43 outwardly slightly so that the assembly may be lowered into the operative position shown in FIG. 3**.

While in the foregoing I have disclosed an embodiment of the invention in considerable detail for purposes of illustration, it will be understood by those skilled in the art that many of these details may be varied without departing from the spirit and scope of the invention.

I claim:

1. A decanting centrifuge comprising a base housing a motor having an upstanding drive shaft; and electromagnet coaxially mounted upon said drive shaft for rotation therewith; said electromagnet having lateral pole faces; a rotor head assembly secured to said drive shaft for rotation therewith; said rotor head assembly including an annular support member coaxial with said shaft and a plurality of magnetically-attractable open-topped tube carriers pivotally suspended from said member about said electromagnet; said tube carriers being adapted to support centrifuge tubes and being pivotally movable between substantially vertical decant positions wherein said carriers rest directly against the pole faces of said electromagnet and outwardly inclined spin positions wherein the carriers are spaced outwardly from said pole faces under the influence of centrifugal force; said electromagnet being selectively energizable for magnetically holding said carriers in said decant positions during rotation of said rotor head assembly for decanting under centrifugal force the liquid contents of the tubes supported by such carriers.

2. The centrifuge of claim 1 in which said lateral pole faces of said electromagnet are planar; said tube carriers having planar contact surfaces for direct surface engagement with said planar pole faces when said carriers are in their decant positions.

3. The centrifuge of claim 2 in which said magnet includes spaced upper and lower poles; said poles each having a horizontal outline of an equilateral polygon with said pole faces being coincident with the sides of such polygon.

4. The centrifuge of claim 2 in which each tube carrier includes a tube-holding member and a planar contact member; said tube-holding and contact members each having an upper end portion independently and pivotally suspended from said annular support member and being adjustably connected to each other at their lower ends for selectively adjusting the angle of said tube-holding member when said rotor head assembly is rotated while said carriers are magnetically held in their decant position.

5. The centrifuge of claim 4 in which said annular support member includes a support ring coaxial with said drive shaft; said contact member and said tube-holding member of each carrier having apertures adjacent their upper ends through which said ring extends for independently pivotally suspending said contact and tube-holding members.

6. The centrifuge of claim 5 in which each of said apertures is substantially larger than the cross section of said ring to permit self-adjustment of said contact members into full planar surface engagement with said planar pole faces of said electromagnet.

7. The centrifuge of claim 1 in which each of said tube carriers has an open-topped cavity defined by upstanding side walls; said side walls including a pair of substantially planar walls meeting along a line which is generally vertical when said carrier is in its decant position and which extends along the outer limits of said cavity; said pair of planar walls meeting each other at an included angle within the general range of 70° to 170° for contacting a centrifuge tube within said cavity along a pair of spaced parallel lines during centrifuge operation.

8. The centrifuge of claim 1 in which said rotor head assembly is detachably secured to said drive shaft for separation from said shaft and electromagnet.

9. The centrifuge of claim 8 in which said electromagnet is provided with a frusto-conical top surface for camming said tube carriers into their decant positions as said rotor head assembly is lowered upon said electromagnet and into operative engagement with said shaft.

10. A rotor head assembly adapted for detachable mounting upon an upstanding rotatable electromagnet of a decanting centrifuge, said rotor head assembly comprising an annular support member and a plurality of magnetically-attractable open-topped tube carriers pivotally suspended from said support member; each tube carrier including a tube-holding member and a magnet-contacting member; said tube-holding member and magnet-contacting member each having an upper end portion independently and pivotally suspended from said annular support member and being adjustably connected to each other at their lower ends for selectively adjusting the maximum angle therebetween for controlling the discharge of fluid from a centrifuge tube supported by said tube-holding member during a decanting operation.

11. The assembly of claim 10 in which said magnet-contacting member has a planar face for directly contacting an electromagnet of a centrifuge.

12. The assembly of claim 10 in which said annular support member includes a support ring; said magnet-contacting member and said tube-holding member of each carrier having apertures adjacent their upper ends through which said ring extends for independently pivotally suspending said magnet-contacting member and tube-holding member therefrom.

13. The assembly of claim 12 in which each of said apertures is substantially larger than the cross section of said ring.

14. The assembly of claim 13 in which said magnet-contacting member includes a beam section and a magnetically-attractable plate section; said sections being permanently secured together; said planar surface being provided by said plate section.

15. The assembly of claim 10 in which each of said tube-holding members has an open-topped cavity defined by upstanding side walls; said side walls including a pair of substantially planar outer side walls meeting along a line which extends in the plane of pivotal movement of such carrier and which extends along the outer limits of said cavity; said pair of planar outer side walls meeting each other at an included angle within the range of 70° to 170° for contacting a centrifuge tube within said cavity along a pair of spaced parallel lines.

16. The assembly of claim 15 in which a centrifuge tube is disposed within said open-topped cavity and is engagable with said planar outer side walls along said pair of spaced parallel lines.

17. The assembly of claim 15 in which said planar outer side walls meet each other at an included angle within the general range of 90° to 150°.

18. The assembly of claim 17 in which said included angle is approximately 120°.

19. The assembly of claim 15 in which said planar outer side walls are integral and continuous with each other along said line of meeting.

20. A rotor head assembly for a laboratory centrifuge comprising an annular support member and a plurality a centrifuge tube carriers pivotally suspended from said support member at circumferentially-spaced points about the periphery thereof; each of said tube carriers having an open-topped cavity defined by upstanding side walls; said side walls including a pair of substantially planar outer side walls meeting along a line which lies in the plane of pivotal movement of such carrier and which extends along the outermost limits of said cavity; said pair of planar outer walls meeting each other at an included angle within the general range of 70° to 170° for contacting a centrifuge tube disposed within said cavity along a pair of spaced parallel lines.

21. The assembly of claim 20 in which said included angle falls within the range of 90° to 150°.

22. The assembly of claim 20 in which said included angle is approximately 120°.

23. The assembly of claim 20 in which said planar outer side walls are integral and continuous along said line of meeting.

* * * * *